US006178937B1

(12) United States Patent
Solomon et al.

(10) Patent No.: US 6,178,937 B1
(45) Date of Patent: Jan. 30, 2001

(54) ROCKER ARM FIXTURE

(75) Inventors: William D. Solomon, Grass Lake; Erin C. Lickfelt; Mark A. Herioux, both of Jackson, all of MI (US)

(73) Assignee: TMJ Properties, L.L.C., Jackson, MI (US)

( * ) Notice: Under 35 U.S.C. 154(b), the term of this patent shall be extended for 0 days.

(21) Appl. No.: 09/307,019

(22) Filed: May 7, 1999

(51) Int. Cl.[7] ..... F01L 1/18

(52) U.S. Cl. ..... 123/90.41; 123/90.39; 123/193.5

(58) Field of Search ..... 123/90.39, 90.41, 123/90.42, 90.43, 90.44, 90.45, 90.47, 195 R, 195 A, 193.5, 193.3; 74/519, 559

(56) References Cited

U.S. PATENT DOCUMENTS 3,870,024 * 3/1975 Ridgeway ..... 123/90.41
4,086,887 * 5/1978 Schoonover et al. ..... 123/90.39
5,095,861 * 3/1992 Dove, Jr. ..... 123/90.39
5,596,958 * 1/1997 Miller ..... 123/90.23
5,617,818 * 4/1997 Luders ..... 123/90.27
5,636,600 * 6/1997 Sweetland et al. ..... 123/90.4
5,970,932 * 10/1999 Richardson et al. ..... 123/90.36

* cited by examiner

*Primary Examiner*—Weilun Lo
(74) *Attorney, Agent, or Firm*—Young & Basile, P.C.

(57) ABSTRACT

A fixture for positioning internal combustion engine rocker arm pedestals prior to bolting the pedestals to the engine. The fixture is a molded synthetic plastic body having recesses for receiving the rocker arm pedestals and fingers within the recesses maintain the pedestals therein. The fixture also includes positioning surfaces cooperating with engine components to assure proper positioning of the pedestals, and the fixture remains in the engine eliminating the necessity for removing the same after the pedestals are bolted in place.

8 Claims, 3 Drawing Sheets

ROCKER ARM FIXTURE

BACKGROUND OF THE INVENTION.

1. Field of the Invention

The invention pertains to assembly fixtures for properly positioning internal combustion engine rocker arm pedestals prior to the pedestals being bolted to engine structure.

2. Description of the Related Art

While fixtures for positioning elements prior to final assembly with another component are known, the need for a low cost fixture for positioning rocker arm pedestals in an internal combustion engine has long existed. Because of the complexity of the configuration and shape of an engine inlet manifold, it has been very difficult to provide a fixture which would accurately hold rocker arm pedestals in position prior to the pedestals being bolted to the engine structure. Prior attempts to utilize an assembly fixture for rocker arm pedestals have not been universally acceptable, and prior to the advent of the instant invention, considerable time and expense has been wasted in the difficulty of properly positioning rocker arm pedestals prior to assembly.

OBJECTS OF THE INVENTION.

It is an object of the invention to provide a fixture for the positioning of rocker arm pedestals in an internal combustion engine prior to the pedestals being bolted to the engine structure.

Yet another object of the invention is to provide a fixture for positioning rocker arm pedestals which firmly holds the pedestals within the fixture during handling of the fixture, and wherein the fixture does not interfere with the mounting of the pedestals in the engine.

An additional object of the invention is to provide a rocker arm pedestal fixture which is of a molded configuration having a shape which corresponds to the engine inlet manifold and wherein the fixture configuration readily "nests" within the engine components to permit the assembler to recognize proper alignment between the pedestals and their mounting holes.

A further object of the invention is to provide an assembly fixture for internal combustion engine rocker arm pedestals which is molded of a low cost temperature resistant synthetic material which may remain in the engine without adverse effect.

SUMMARY OF THE INVENTION.

An internal combustion engine rocker arm fixture in accord with the invention consists of an elongated molded body of a complex configuration. The body is preferably molded of a temperature resistant synthetic material, such as a glass fiber reinforced resin, and is capable of withstanding the temperatures exteriorly encountered with an automotive internal combustion engine without significant degradation.

The fixture body includes a lower side which is configured to cooperate with the shape of the engine inlet manifold so that the fixture will firmly rest upon the engine surfaces adjacent the location where the rocker arm pedestals are mounted. Further, the fixture body includes recesses or rests which provide clearance for the engine push rods and springs, and further aid in positioning of the fixture within the engine.

The body consists of a plurality of enlargements or islands interconnected by relatively thin bridges forming a relatively rigid structure. A rectangular recess is defined within each of the islands adapted to snugly receive a rocker arm pedestal. Each of the recesses is provided with means for holding a pedestal within the recess consisting of a resilient finger having a barb on its free end adapted to cooperate with a shoulder defined on the pedestal. Vertical positioning of the pedestal within the recess is determined by a pair of projections formed on opposite sides of the recess which engage locating surfaces formed in notches defined on the pedestals. In this manner, the fingers and projections prevent the pedestals from being removed from the associated recess, and the snug relationship between the recess and the pedestals assures that the pedestals will be properly located within the recesses, and the fixture.

After the rocker arm pedestals have been inserted within all of the fixture recesses, the pedestals, usually six in number, and the fixture are placed within the engine and properly located by the configuration of the fixture relative to the engine components, and the pedestals can be quickly firmly attached to the engine structure by the usual bolts extending through the pedestal countersunk bores.

The configuration of the fixture, and its composition, permits all of the fixture components to be homogeneously molded in one operation at low cost, and the relationship of the fixture to the pedestals is such that the fixture may remain in place within the engine during normal engine operation without interfering in any way with engine function.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
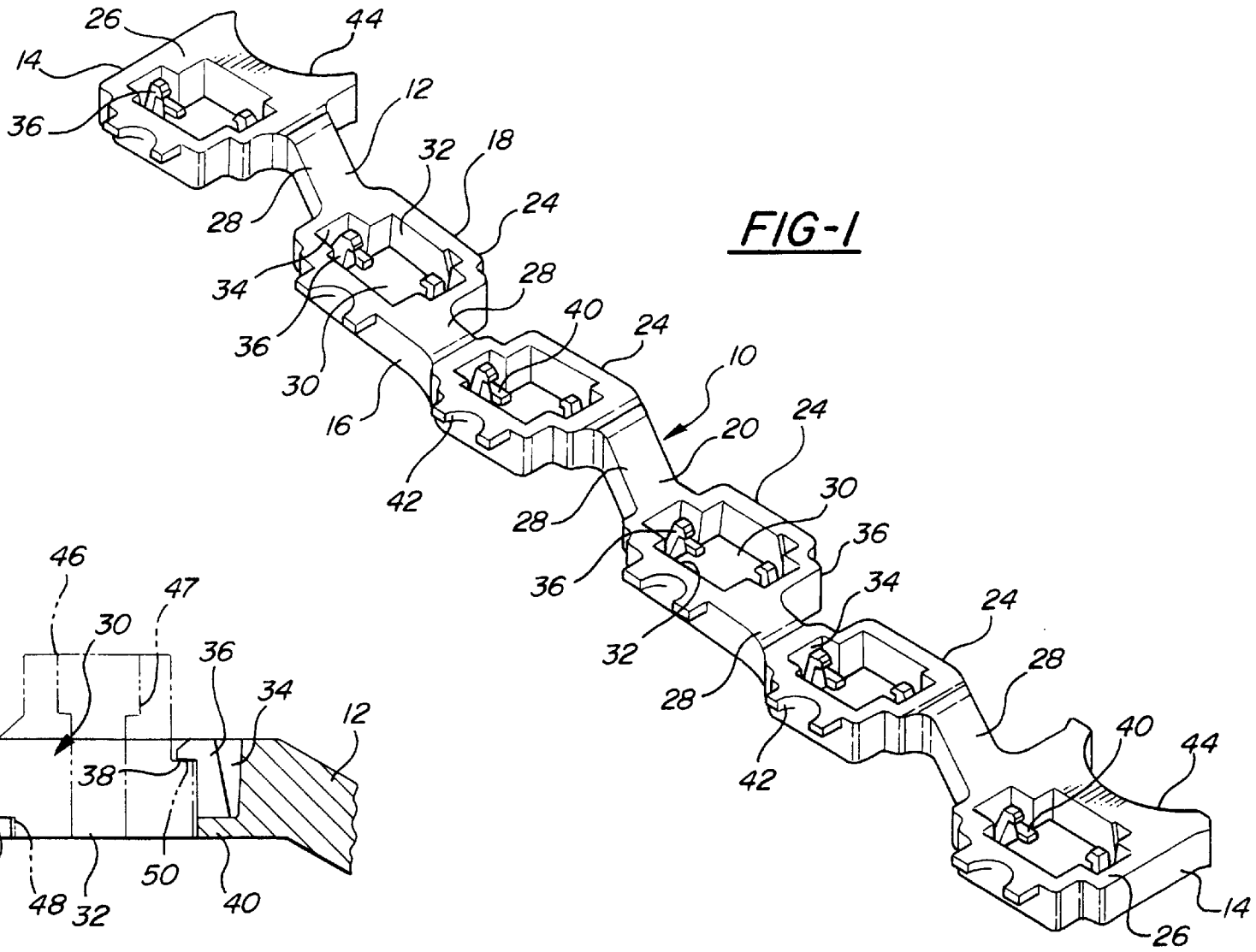
FIG. 1 is a perspective view of an internal combustion engine rocker arm pedestal fixture in accord with the invention.
Figure 2:
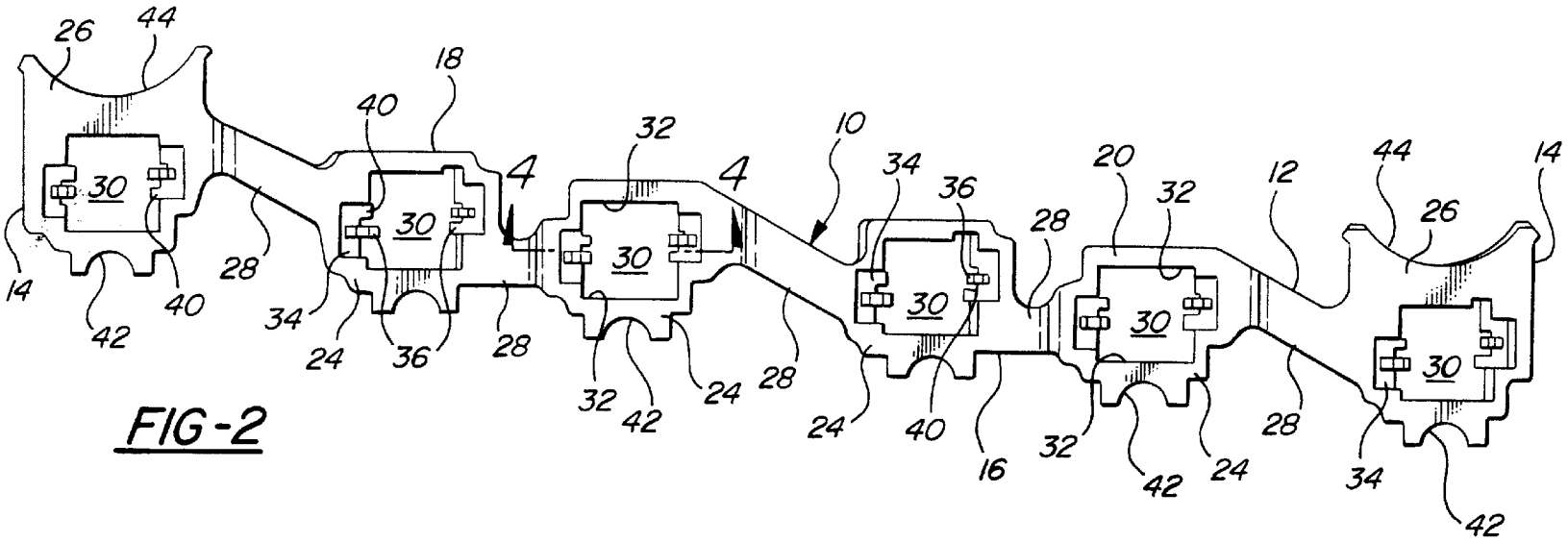
FIG. 2 is a plan view of the fixture.
Figure 3:
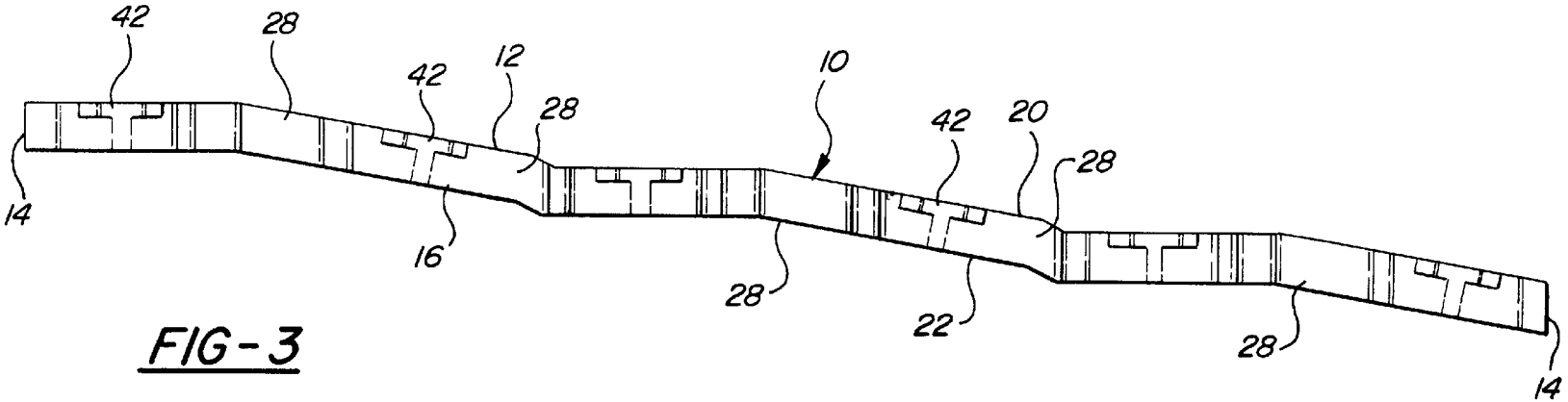
FIG. 3 is an elevational side view of the fixture as taken from the bottom of FIG. 2.

The overall configuration of the rocker arm assembly fixture is best apparent from FIGS. 1–3 wherein the configuration of the fixture 10 will be appreciated. The fixture 10 consists of a molded body 12 having ends 14, lateral sides 16 and 18, a top surface 20 and a bottom surface 22.

Preferably, the body 12 is molded of a synthetic relatively rigid heat resistant material such as glass fiber reinforced resin.

As will be appreciated from FIG. 3, the body 12 does not lie in a single plane but is contoured to accommodate the configuration of the internal combustion engine intake chamber or manifold in which it will be mounted, as later described, and while the body bottom surface 22 basically consists of a series of flat surface portions, these portions are not co-planar as will be apparent from FIG. 3.

The body 12 includes a plurality of enlarged portions or islands 24 intermediate its ends, and outer island 26 are located at the ends of the body and are of a larger configuration than the inner islands 24. Adjacent islands are interconnected by homogeneous bridges 28, and sufficient material exists within the bridges, and the thickness of the body 12 is such, that the entire body 12 is rigid and capable of maintaining dimensional and contoured integrity.

Each of the islands 24 and 26 includes a rectangular recess 30 in which a rocker arm pedestal will be mounted, as later described. The recesses 30 include opposed planar parallel sides 32, and the other opposed recessed sides each include a well 34, as best apparent in FIG. 4. Each of the wells 34 includes an upstanding cantilevered finger 36 whose free upper end includes a barb 38, FIG. 4, having a lower flat surface. Also, each of the wells 34 includes a projection 40 extending into the associated recess 30 to aid in the vertical positioning of the pedestals, as later described.

At each of the islands 24 and 26, on body side 16, a push rod rest or cradle 42 is defined for accommodating the engine push rods, and each of the outer islands 26 is provided with a spring rest or cradle 44 defined on body side 18 to provide accommodation for the engine valve springs, as later described.

Figure 4:
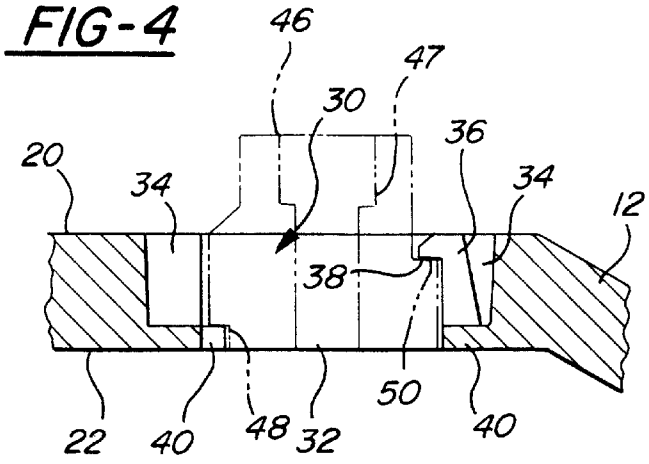
FIG. 4 is an enlarged detail elevational sectional view as taken through a fixture recess along Section 4—4 of FIG. 2.
Figure 5:
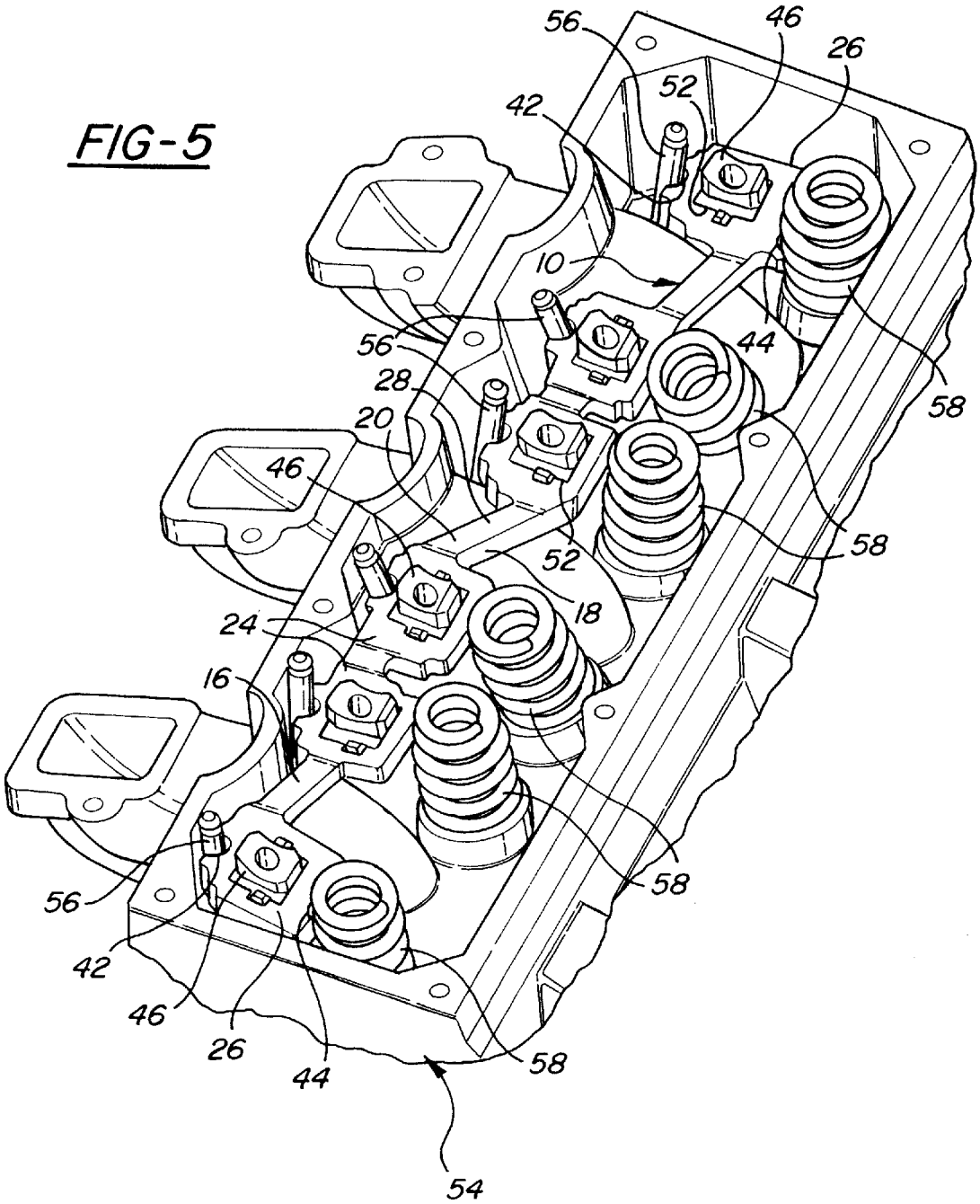
FIG. 5 is a perspective view of an internal combustion engine inlet manifold illustrating a fixture in accord with the invention in position with the rocker arm pedestals within the fixture.

A typical rocker arm pedestal 46 with which the fixture 10 of the invention is used is shown in dotted lines in FIG. 4, and appears in full lines in FIG. 5. The upper surface of the pedestal 46 is of a concave configuration to accommodate the bearing structure of the rocker arm, and the pedestal includes an internal bore 47 which is countersunk to provide an internal shoulder permitting a screw, not shown, to be inserted through the bore and the screw head will engage upon the bore shoulder.

Adjacent its lower end, the pedestal 46 is provided with a pair of notches 48, and at approximately one-half its height, the pedestal 46 includes a notch defining a ledge 50. The pedestal 46 also includes opposite parallel sides 52 which are spaced apart a distance only slightly less than the distance separating the recess sides 32 whereby the insertion of the pedestal within the recesses 30 such that the sides 52 engage the recess sides 32 results in a snug fit of the pedestals within the recesses 30.

The internal combustion engine with which the invention is used is shown at 54 in FIG. 5. The illustrated engine represents one bank of a V-6 cylinder engine. The engine includes push rods 56 and a pair of valve springs 58 are associated with each cylinder. For purposes of illustration, much of the rocker arm structure required with the engine 54 is not shown. Such rocker arm structure being mounted upon the pedestals 46 as is well known.

In use, a rocker arm pedestal 46 is located within each recess 30. The pedestals 46 are inserted through the top surface 20 of body 12 and the configuration of the free outer ends of the fingers 36 is such as to permit the pedestals to temporarily deform the fingers 36 away from the pedestals permitting the pedestals to be received within the associated recess. Upon the pedestal being sufficiently inserted into its recess, the pedestal notch 48 will engage the body projection 40 preventing further insertion of the pedestal into the recess, and at such time, the finger barbs 38 will spring inwardly to overlie the ledges 50 defined upon the pedestals. Accordingly, in this manner, the pedestals 46 will be firmly "locked" within the body recesses 30, and the assembled fixture 10 and pedestals 46 can be handled and stored as a unit.

When it is desired to install the pedestals 46 within the engine 54, the body 12 and pedestal 46 assembly is located within the engine intake manifold in a manner apparent from FIG. 5. Because of the configuration of the body lower surface 22, the operator can feel when the body 12 is properly located within the engine intake manifold, the engine push rods 56 will be within the push rod rests 42, and the outer tension springs 58 will be located within the body spring rest 44. When the fixture 10 is so located, the pedestal bores 47 will be aligned with the threaded bores in the engine 54, not shown, adapted to receive the pedestal bolts which are inserted through the pedestal bores 47 and tightened to firmly mount the pedestals individually upon the engine.

After the bolts extending through the pedestals 46 are firmly tightened, the pedestals will be properly located upon the engine, and the fixture 10 performs no further purpose. However, because the fixture 10 is molded of a temperature resistant material, the fixture can remain within the engine intake manifold and in no way interferes with the engine operation.

It will be appreciated that the fixture 10 permits the pedestals 46 to be quickly and accurately located within the engine 54 for assembly purposes substantially reducing the assembly time, and reducing the likelihood of assembly error, and the low cost of the molded fixture 10, although only used once, is significantly less than the labor and time saved.

It is appreciated that various modifications to the inventive concepts may be apparent to those skilled in the art without departing from the spirit and scope of the invention.

What is claimed is:

1. A fixture for positioning rocker arm pedestals in an internal combustion engine comprising, in combination, an elongated body having first and second ends, first and second lateral sides, an upper surface and a lower surface, locating surfaces defined on said body lower surface and on at least one of said body lateral sides for accommodating engine structure to locate said body upon the engine, and rocker arm pedestal retaining means defined on said body for holding and locating a rocker arm pedestal prior to and during attachment to an engine.

2. In a fixture as in claim 1, said body being molded of a synthetic material.

3. In a fixture as in claim 2, said body being molded of a reinforced glass fiber resin material.

4. In a fixture as in claim 1, said rocker arm pedestal retaining means comprising a recess defined in said body adapted to snugly receive a rocker arm pedestal.

5. In a fixture as in claim 4, holding means defined on said body located within said recesses holding the rocker arm pedestal within the associated recess.

6. In a fixture as in claim 5, said holding means comprising a resilient hook having a barb engaging a rocker arm pedestal within the associated recess.

7. In a fixture as in claim 6, two hooks being defined within each recess.

8. In a fixture as in claim 6, said body being molded of a single mass of synthetic material and said hooks being homogeneously formed of the material of said body.

* * * * *